US010864768B2

(12) United States Patent
Conrad

(10) Patent No.: US 10,864,768 B2
(45) Date of Patent: Dec. 15, 2020

(54) FOLDABLE PALETTE BLANK

(71) Applicant: Pratt Corrugated Holdings, Inc., Conyers, GA (US)

(72) Inventor: Hannah Conrad, Memphis, TN (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 149 days.

(21) Appl. No.: 16/108,163

(22) Filed: Aug. 22, 2018

(65) Prior Publication Data

US 2018/0354294 A1 Dec. 13, 2018

Related U.S. Application Data

(62) Division of application No. 15/239,360, filed on Aug. 17, 2016, now Pat. No. 10,105,986.

(51) Int. Cl.
*B44D 3/02* (2006.01)
*B31D 1/00* (2017.01)

(52) U.S. Cl.
CPC ..... *B44D 3/02* (2013.01); *B31D 1/00* (2013.01)

(58) Field of Classification Search
None
See application file for complete search history.

(56) References Cited

U.S. PATENT DOCUMENTS

D13,851 S 4/1883 Murray
289,700 A 12/1883 Parker
307,768 A 11/1884 Heysinger
D34,603 S 6/1901 Doyle
685,074 A 10/1901 Wiehl
718,296 A * 1/1903 Adamson ..... B44D 3/04 206/1.8
D37,976 S 5/1906 Rhoades
1,484,613 A 2/1924 Carmel
2,137,477 A 11/1938 De Haven
D117,639 S 11/1939 Rich
2,295,860 A 9/1942 Oliver
(Continued)

OTHER PUBLICATIONS

Conrad, Hannah; Corrected Notice of Allowance for U.S. Appl. No. 15/239,360, filed Aug. 17, 2016, dated Sep. 25, 2018, 9 pgs.
(Continued)

*Primary Examiner* — Hemant Desai
*Assistant Examiner* — Tanzim Imam
(74) *Attorney, Agent, or Firm* — Taylor English Duma LLP

(57) ABSTRACT

A method of forming a palette includes obtaining a foldable palette blank, the foldable palette blank including a working portion, the working portion defining a first working surface and a second working surface opposite from the first working surface, the working portion defining a working hand hole, the working portion defining a reservoir hole extending from the first working surface to the second working surface; and a support portion, the support portion defining a first support surface and a second support surface opposite from the first support surface, the support portion defining a support hand hole, the support portion configured to cover an end of the reservoir hole; positioning the working portion in facing contact with the support portion; aligning the working hand hole with the support hand hole; and covering the end of the reservoir hole with the support portion to form a reservoir.

14 Claims, 6 Drawing Sheets

(56) References Cited

U.S. PATENT DOCUMENTS

| | | | | |
|---|---|---|---|---|
| 2,310,752 | A * | 2/1943 | Sillman | B44D 3/02 52/309.15 |
| D150,279 | S | 7/1948 | Wies | |
| D156,874 | S | 1/1950 | Emmons | |
| 2,656,633 | A | 10/1953 | Bergen | |
| D172,222 | S | 5/1954 | Coverdell | |
| D176,876 | S | 2/1956 | Miller | |
| D180,118 | S | 4/1957 | Styka | |
| D184,597 | S | 3/1959 | Berman | |
| 2,923,081 | A | 2/1960 | Simmons | |
| D219,785 | S | 1/1971 | Sallak | |
| 3,732,972 | A | 5/1973 | Israel | |
| 3,779,369 | A | 12/1973 | Lang | |
| 3,804,030 | A | 4/1974 | Israel | |
| 3,856,140 | A | 12/1974 | Fitts | |
| D254,555 | S | 3/1980 | Kean et al. | |
| 4,600,592 | A | 7/1986 | Dobis | |
| 4,735,306 | A | 4/1988 | Smit | |
| 4,884,680 | A | 12/1989 | Israel et al. | |
| 5,277,302 | A | 1/1994 | Seisa | |
| D354,513 | S | 1/1995 | Jay | |
| D362,018 | S | 9/1995 | Damm | |
| 5,484,637 | A | 1/1996 | Paragon et al. | |
| 5,590,785 | A | 1/1997 | Seitzinger | |
| D408,056 | S | 4/1999 | Broyles | |
| D409,655 | S | 5/1999 | Broyles | |
| 6,189,698 | B1 | 2/2001 | Asser | |
| D463,820 | S | 10/2002 | Lorber | |
| 6,532,617 | B2 | 3/2003 | Russo | |
| 6,745,907 | B2 | 6/2004 | Kjelgaard | |
| 7,572,210 | B2 | 8/2009 | Marinello | |
| D611,306 | S | 3/2010 | Zack et al. | |
| 8,746,456 | B1 | 6/2014 | Bradley | |
| D708,062 | S | 7/2014 | Musi Navarro | |
| D731,249 | S | 6/2015 | Keeth | |
| D755,291 | S | 5/2016 | Klideris | |
| D776,485 | S | 1/2017 | Bradley | |
| 9,931,886 | B2 | 4/2018 | Borse et al. | |
| D822,107 | S | 7/2018 | Conrad | |
| D824,597 | S | 7/2018 | Cardis | |
| 10,105,986 | B2 | 10/2018 | Conrad | |
| D860,540 | S | 9/2019 | Cardis | |
| 10,456,759 | B2 | 10/2019 | Henry et al. | |
| D881,273 | S | 4/2020 | Conrad | |
| 2004/0200870 | A1* | 10/2004 | Haber | A45F 3/14 224/259 |
| 2006/0283719 | A1 | 12/2006 | Surabischwili | |
| 2009/0321282 | A1 | 12/2009 | Asmaro | |
| 2010/0032322 | A1* | 2/2010 | O'Neill | B44D 3/02 206/1.9 |
| 2011/0005962 | A1 | 1/2011 | Hirz et al. | |
| 2011/0198356 | A1 | 8/2011 | Lee | |
| 2011/0259763 | A1 | 10/2011 | O'Brien | |
| 2017/0080746 | A1 | 3/2017 | Borse et al. | |
| 2018/0050557 | A1 | 2/2018 | Conrad | |

OTHER PUBLICATIONS

Conrad, Hannah; Final Office Action for U.S. Appl. No. 15/239,360, filed Aug. 17, 2016, dated Feb. 15, 2018, 19 pgs.
Conrad, Hannah; Issue Notification for U.S. Appl. No. 15/239,360, filed Aug. 17, 2016, dated Oct. 3, 2018, 1 pg.
Conrad, Hannah; Non Final Office Action for U.S. Appl. No. 15/239,360, filed Aug. 17, 2016, dated Sep. 13, 2017, 34 pgs.
Conrad, Hannah; Notice of Allowance for U.S. Appl. No. 15/239,360, filed Aug. 17, 2016, dated May 21, 2018 13 pgs.
Conrad, Hannah; Restriction Requirement for U.S. Appl. No. 15/239,360, filed Aug. 17, 2016, dated Mar. 9, 2017, 6 pgs.
Conrad, Hannah; Corrected Notice of Allowance for U.S. Appl. No. 29/574,647, filed Aug. 17, 2016, dated May 31, 2018, 8 pgs.
Conrad, Hannah; Issue Notification for U.S. Appl. No. 29/574,647, filed Aug. 17, 2016, dated Jun. 13, 2018, 1 pg.
Conrad, Hannah; Notice of Allowance for U.S. Appl. No. 29/574,647, filed Aug. 17, 2016, dated Feb. 22, 2018, 36 pgs.
Conrad, Hannah; Non-Final Office Action for U.S. Appl. No. 29/647,032, filed May 9, 2018, dated Nov. 18, 2019, 31 pgs.
Conrad, Hannah; Notice of Allowance for U.S. Appl. No. 29/647,032, filed May 9, 2018, dated Feb. 18, 2020, 5 pgs.

* cited by examiner

FOLDABLE PALETTE BLANK

REFERENCE TO RELATED APPLICATIONS

This application is a divisional of U.S. application Ser. No. 15/239,360, filed Aug. 17, 2016, which is hereby specifically incorporated by reference herein in its entirety.

TECHNICAL FIELD

This disclosure relates to art supplies. More specifically, this disclosure relates to palettes used for painting.

BACKGROUND

Painters, artists, and art students frequently use palettes as a means for holding different colors of paint while painting. A palette allows the user to remain mobile, for instance when painting a large mural, while maintaining convenient access to a variety of colors. Users also often use a top surface of the palette to mix paints of differing colors to develop a specific shade or hue. Conventional palettes and associated painting supplies are often expensive which can prevent beginners, casual hobbyists, art students, and individuals of limited economic means from taking up or practicing painting. Additionally, conventional palettes must be cleaned after each use which can be time consuming and burdensome in environments where the palettes are frequently used, such as in an art classroom. Conventional palettes also typically come in a right-handed configuration and are not adaptable between users of differing hand dominance. Consequently, left-handed users often must adapt to the palette's configuration which can be uncomfortable. Accordingly, an economical and disposable palette which can be adapted for left-handed or right-handed use can be desirable.

SUMMARY

Disclosed is a foldable palette blank including a working portion defining a first working surface and a second working surface opposite from the first working surface, the working portion defining a reservoir hole extending from the first working surface to the second working surface; a support portion defining a first support surface and a second support surface opposite from the first support surface; and a hinge disposed between the working portion and the support portion of the foldable palette blank, the hinge flexibly connecting the working portion to the support portion, the hinge foldable about a hinge axis; wherein the support portion is configured to cover an end of the reservoir hole when the foldable palette blank is folded about the hinge, and the working portion is positioned in facing contact with the support portion.

Also disclosed is a palette including an upper layer, the upper layer defining a first working surface and a second working surface opposite from the first working surface, the upper layer defining a reservoir hole extending from the first working surface to the second working surface; and a lower layer, the lower layer defining a first support surface and a second support surface opposite from the first support surface, the second support surface in facing contact with the second working surface, the second support surface covering the reservoir hole.

Also disclosed is a method of forming a palette including obtaining a foldable palette blank, the foldable palette blank including a working portion, the working portion defining a first working surface and a second working surface opposite from the first working surface, the working portion defining a working hand hole extending from the first working surface to the second working surface, the working portion defining a reservoir hole extending from the first working surface to the second working surface; and a support portion, the support portion defining a first support surface and a second support surface opposite from the first support surface, the support portion defining a support hand hole extending from the first support surface to the second support surface, the support portion configured to cover an end of the reservoir hole; positioning the working portion in facing contact with the support portion; aligning the working hand hole with the support hand hole; and covering the end of the reservoir hole with the support portion to form a reservoir.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
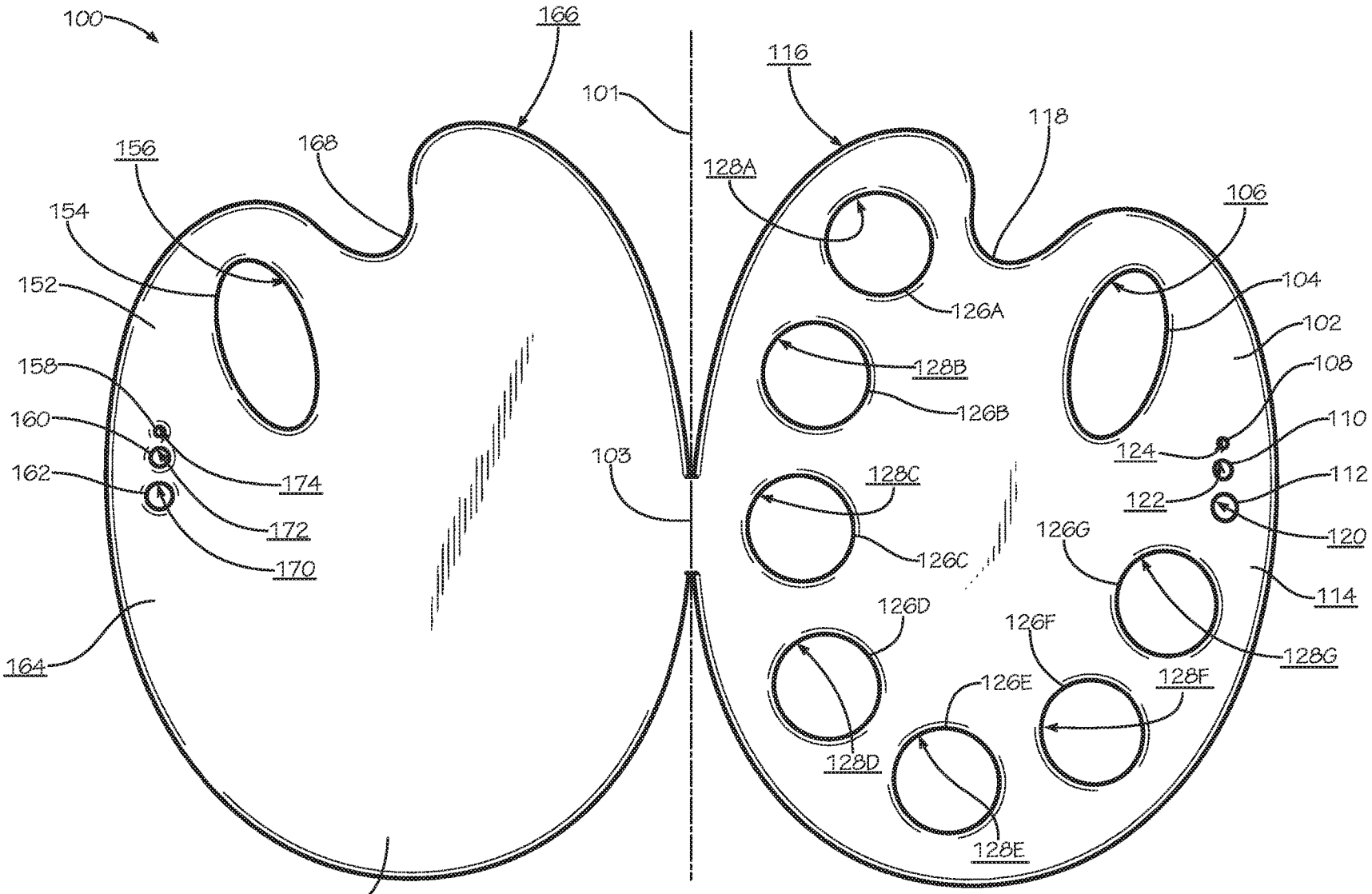
FIG. 1 is a top view of a foldable palette blank according to an embodiment of the present disclosure comprising a working portion and a support portion connected by a hinge.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in their best, currently known embodiments. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can comprise two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "can," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or Steps are included or are to be performed in any particular embodiment.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

Disclosed is a foldable palette blank and associated methods, systems, devices, and various apparatus. In various embodiments, the foldable palette blank includes a working portion and a support portion that are joined by a hinge that may be folded to form a palette. It would be understood by one of skill in the art that the disclosed foldable palette blank is described in but a few exemplary embodiments among many. No particular terminology or description should be considered on the disclosure or the scope of any claims issuing therefrom.

A top view of one embodiment of a foldable palette blank 100 is shown in FIG. 1. The foldable palette blank 100 defines a first blank surface 105 and a second blank surface (not shown) opposite from the first blank surface 105. Both the first blank surface 105 and the second blank surface can be substantially planar. The foldable palette blank 100 can comprise a working portion 102 and a support portion 152. The working portion 102 and the support portion 152 can be flexibly connected by a hinge 103 foldable about a hinge axis 101. In some embodiments, the hinge 103 can be a living hinge. The hinge 103 allows for the working portion 102 and the support portion 152 to be folded relative to one another and positioned with the working portion 102 in facing contact with the support portion 152. The working portion 102 defines a first working surface 114 and a second working surface 514 (FIGS. 5-8) opposite from the first working surface 114. The working portion 102 defines a working edge surface 116 at an outer perimeter of the working portion 102. The working portion 102 can also define a working notch 118 and a working hand hole 104 configured to allow a user to grip the foldable palette blank 100. The working hand hole 104 extends from the first working surface 114 to the second working surface 514 and defines a working hand hole inner surface 106.

The working portion 102 can further define one or more working brush holes 108, 110, 112 extending from the first working surface 114 to the second working surface 514. In the embodiment shown, the working portion 102 defines a working small brush hole 108, a working intermediate brush hole 110, and a working large brush hole 112 which respectively define a working small hole inner surface 124, a working intermediate hole inner surface 122, and a working large hole inner surface 120. However, the quantity and sizing of the working brush holes is not limiting. The foldable palette blank 100 can define any number of working brush holes in any sizes. The inner surfaces 120, 122, 124 can be cylindrical; however, the shape should not be viewed as limiting, and the inner surfaces 120,122, 124 can have any other shape such as frustoconical.

The working portion 102 can also define a plurality of reservoir holes 126A-G (hereafter generally referred to as "reservoir holes 126") extending from the first working surface 114 to the second working surface 514. The reservoir holes 126A-G each respectively define an inner reservoir surface 128A-G (hereafter generally referred as "inner reservoir surfaces 128"). The quantity and size of the reservoir holes 126 should not be considered limiting. In the embodiment shown, the inner reservoir surfaces 128 are cylindrical; however, the shape should not be viewed as limiting, and the inner reservoir surfaces 128 can have any other shape such as frustoconical.

Figure 2:
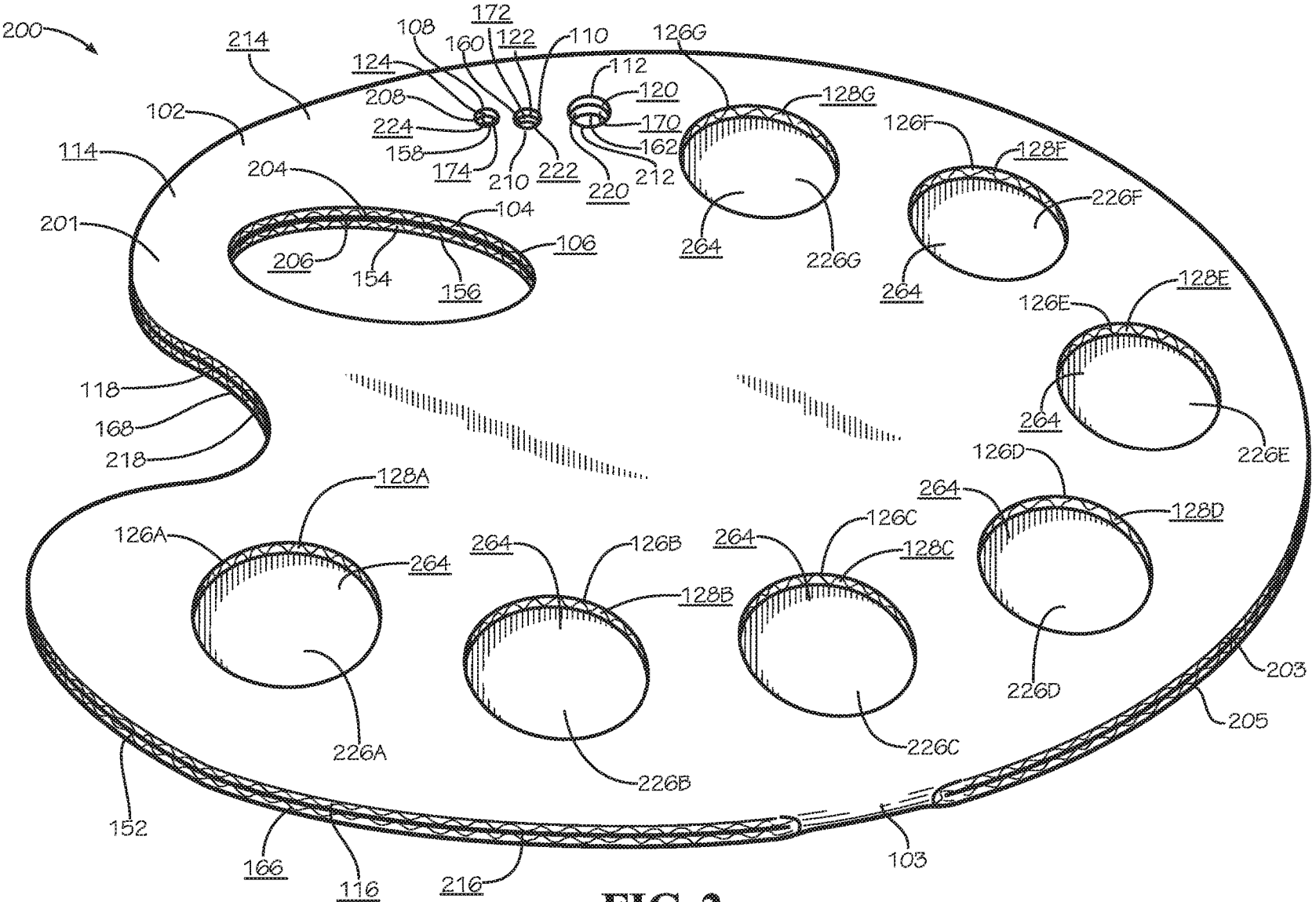
FIG. 2 is a perspective view of one configuration of a palette formed from the foldable palette blank of FIG. 1.

The support portion 152 of the foldable palette blank 100 defines a first support surface 164 and a second support surface 264 (shown in FIG. 2). The first support surface 164 and the first working surface 114 comprise the first blank surface 105, and the second support surface 264 and the second working surface 514 comprise the second blank surface (not shown). The support portion 152 defines a support edge surface 166 at an outer perimeter of the support portion 152. The support edge surface 166 is substantially symmetric to the working edge surface 116 across the hinge axis 101. The support edge surface 166 intersects the working edge surface 116 at both ends of the hinge 103. The support portion 152 can also define a support notch 168 and a support hand hole 154 configured to allow a user to grip the foldable palette blank 100. The support hand hole 154 extends from the first support surface 164 to the second support surface 264 and defines a support hand hole inner surface 156. In the embodiment shown, the working hand hole 104 and the working notch 118 are substantially symmetric to the support hand hole 154 and the support notch 168, respectively, across the hinge axis 101.

The support portion 152 can further define one or more support brush holes 158, 160, 162. In the embodiment shown, the support portion 152 defines a support small brush hole 158, a support intermediate brush hole 160, and a support large brush hole 162 which respectively define a support small hole inner surface 174, a support intermediate hole inner surface 172, and a support large hole inner surface 170. The inner surfaces 170, 172, 174 can be cylindrical; however, the shape should not be viewed as limiting, and the inner surfaces 120,122, 124 can have any other shape such as frustoconical. However, the quantity and sizing of the support brush holes is not limiting. The foldable palette blank 100 can define any number of support brush holes in any sizes, but the support portion 152 can often have the same number and size of support brush holes as the working portion 102 has working brush holes. In the embodiment shown, the support brush holes 158, 160, 162 are substantially symmetric to the working brush holes 108, 110, 112, respectively, across the hinge axis 101. In other embodiments, the support brush holes 158, 160, 162 can be larger or smaller than the respective working brush holes 108, 110, 112.

FIG. 2 shows a perspective view of one configuration of a palette 200 formed from the foldable palette blank of FIG. 1. The hinge 103 allows the foldable palette blank 100 to be folded about the hinge axis 101 into a folded position to form the palette 200. In the folded position, the working portion 102 is positioned in facing contact with the support portion 152. Once folded with the working portion 102 flat against the support portion 152, the working portion 102 is an upper layer 203, and the support portion 152 is a lower layer 205. The configuration shown is a left-handed palette typical for use by a left-handed user in which the palette 200 would be held by the right hand while the dominant left hand is used to paint.

The foldable palette blank 100 can be folded at the hinge 103 in two directions about the hinge axis 101. A first direction folds the foldable palette blank 100 so that the second working surface 514 of the working portion 102 is positioned in facing contact with the second support surface 264 of the support portion 152 as shown in FIG. 2. In this configuration, the top 201 of the upper layer 203 is defined by the first working surface 114 of the working portion 102. The top 201 of the upper layer 203 defines a top surface 214. A second direction folds the foldable palette blank 100 so that the first working surface 114 of the working portion 102 is positioned in facing contact with the first support surface 164 of the support portion 152 (not shown). The choice of folding in the first direction or the second direction allows the foldable palette blank 100 to be configured for use with either a left hand or a right hand of the user. Folding the foldable palette blank 100 about the hinge 103 in the first direction forms the left-handed palette, and folding the foldable palette blank 100 in the second direction forms a right-handed palette (not shown).

In the embodiment shown in FIG. 1, the working portion 102 and the support portion 152 are substantially symmetric across the hinge axis 101 with respect to the working edge surface 116 and the support edge surface 166, the working hand hole 104 and the support hand hole 154, the working notch 118 and the support notch 168, and the working brush holes 108, 110, 112 and the support brush holes 158, 160, 162. Due to the symmetry of these features, when the foldable palette blank 100 is folded about the hinge 103, the working edge surface 116, the working notch 118, the working hand hole 104, and the working brush holes 108, 110, 112 align with the support edge surface 166, the support notch 168, the support hand hole 154, and the support brush holes 158, 160, 162, respectively.

As shown in FIG. 2, the working notch 118 and the support notch 168 of the foldable palette blank 100 define a palette notch 218 of the palette 200. The working edge surface 116 and the support edge surface 166 of the foldable palette blank 100 together define a palette edge surface 216. The working hand hole 104 and the support hand hole 154 together define a palette hand hole 204. The working hand hole inner surface 106 and the support hand hole inner surface 156 of the foldable palette blank 100 together define a palette hand hole inner surface 206. The working small brush hole 108, the working intermediate brush hole 110, and the working large brush hole 112 together with the support small brush hole 158, the support intermediate brush hole 160, and the support large brush hole 162 define the small palette brush hole 208, the intermediate palette brush hole 210, and the large palette brush hole 212, respectively.

The small palette brush hole 208 defines a small palette hole inner surface 224 which comprises the working small hole inner surface 124 and the support small hole inner surface 174. The intermediate palette brush hole 210 defines an intermediate palette hole inner surface 222 which comprises the working intermediate hole inner surface 122 and the support intermediate hole inner surface 172. The large palette brush hole 212 defines a large palette hole inner surface 220 which comprises the working large hole inner surface 120 and the support large hole inner surface 170. In the embodiment shown, the small palette hole inner surface 224, the intermediate palette hole inner surface 222, and the large palette hole inner surface 220 are each substantially cylindrical in shape; however, the shape should not be viewed as limiting. In use, the palette brush holes 208, 210, 212 are configured to hold a tool, such as a brush, when not in use by inserting a handle of the tool into the palette brush hole where the handle is retained by friction or dimensional interference between the handle and the palette brush hole. The palette brush holes 208, 210, 212 are not limited to holding paint brushes and can also hold other tools or supplies such as mahl sticks, pencils, pens, etc.

In some embodiments, the working edge surface 116 and the support edge surface 166, the working hand hole 104 and the support hand hole 154, the working notch 118 and the support notch 168, and the working brush holes 108, 110, 112 and the support brush holes 158, 160, 162 can be slightly asymmetrical. For instance, it can be desirable for the working hand hole 104 and the support hand hole 154 to define slightly different sizes and shapes in order to define a contour for the palette hand hole 204. Similarly, the support brush holes 158, 160, 162 can be sized slightly smaller than the working brush holes 108, 110, 112, so that the inner surfaces 220, 222, 224 of the palette brush holes 208, 210, 212 can each define a taper, such as a frustoconical shape, which can frictionally engage the handle of a tool.

The location of the hinge 103 should not be viewed as limiting. The hinge 103 can join the working portion 102 and the support portion 152 of the foldable palette blank 100 at any point along the working edge surface 116 and the support edge surface 166 as long as the substantially symmetrical relationship is maintained across the hinge axis 101 with respect to the working edge surface 116 and the support edge surface 166, the working hand hole 104 and the support hand hole 154, the working notch 118 and the support notch 168, and the working brush holes 108, 110, 112 and the support brush holes 158, 160, 162.

Figure 3:
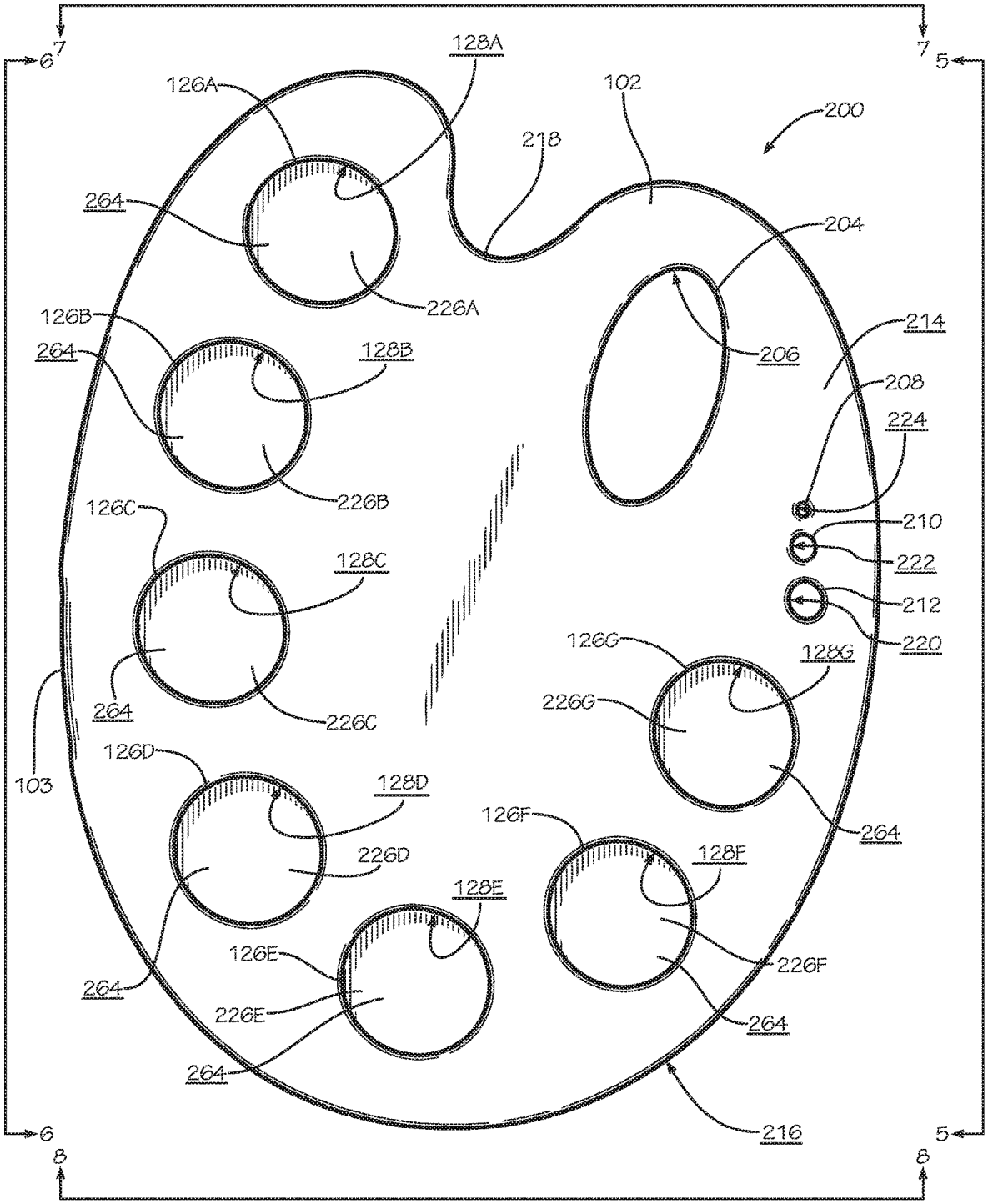
FIG. 3 is a top view of the palette of FIG. 2.

As shown in FIG. 1, the working portion 102 and the support portion 152 are not symmetric across the hinge axis 101 with respect to the reservoir holes 126. The support portion 152 is configured to cover an end of each of the reservoir holes 126 when the foldable palette blank 100 is folded about the hinge 103, and the working portion 102 is positioned in facing contacted with the support portion 152. As shown in FIGS. 2 and 3, the palette 200 comprises reservoirs 226A-G (hereafter generally referred to as "reservoirs 226"). Each reservoir 226 is defined by the second support surface 264 of the support portion 152 and one of the inner reservoir surfaces 128 of the respective reservoir hole 126. The reservoir holes 126 are defined by the upper layer 203 and extend from the first working surface to the second working surface. As shown in the embodiment of FIG. 2, each reservoir 226 has a substantially cylindrical shape; however the shape should not be viewed as limiting. The reservoirs 226 can be dished, conical, polygonal, or any other shape.

The palette 200 arrangement can be permanently secured by using fastening techniques such as glues, tapes, adhesives, or fasteners such as rivets or grommets to secure the working portion 102 and the support portion 152 in the folded position. Alternatively, the palette 200 can be temporarily secured using techniques such as re-adherable strips or glues, hook-and-loop fasteners, magnets, or integral mechanical fasteners such as a foldable tab and a slot. The ability to temporarily secure the palette 200 can be desirable to allow the palette to be re-configured between the left-handed palette and the right-handed palette. Additionally, re-configuring the palette 200 exposes a clean surface which can extend the usable life of the palette 200. Alternatively, the working portion 102 and the support portion 152 of the palette 200 can remain unsecured during use, and the user's hand can hold the palette 200 in the folded configuration.

Figure 4:
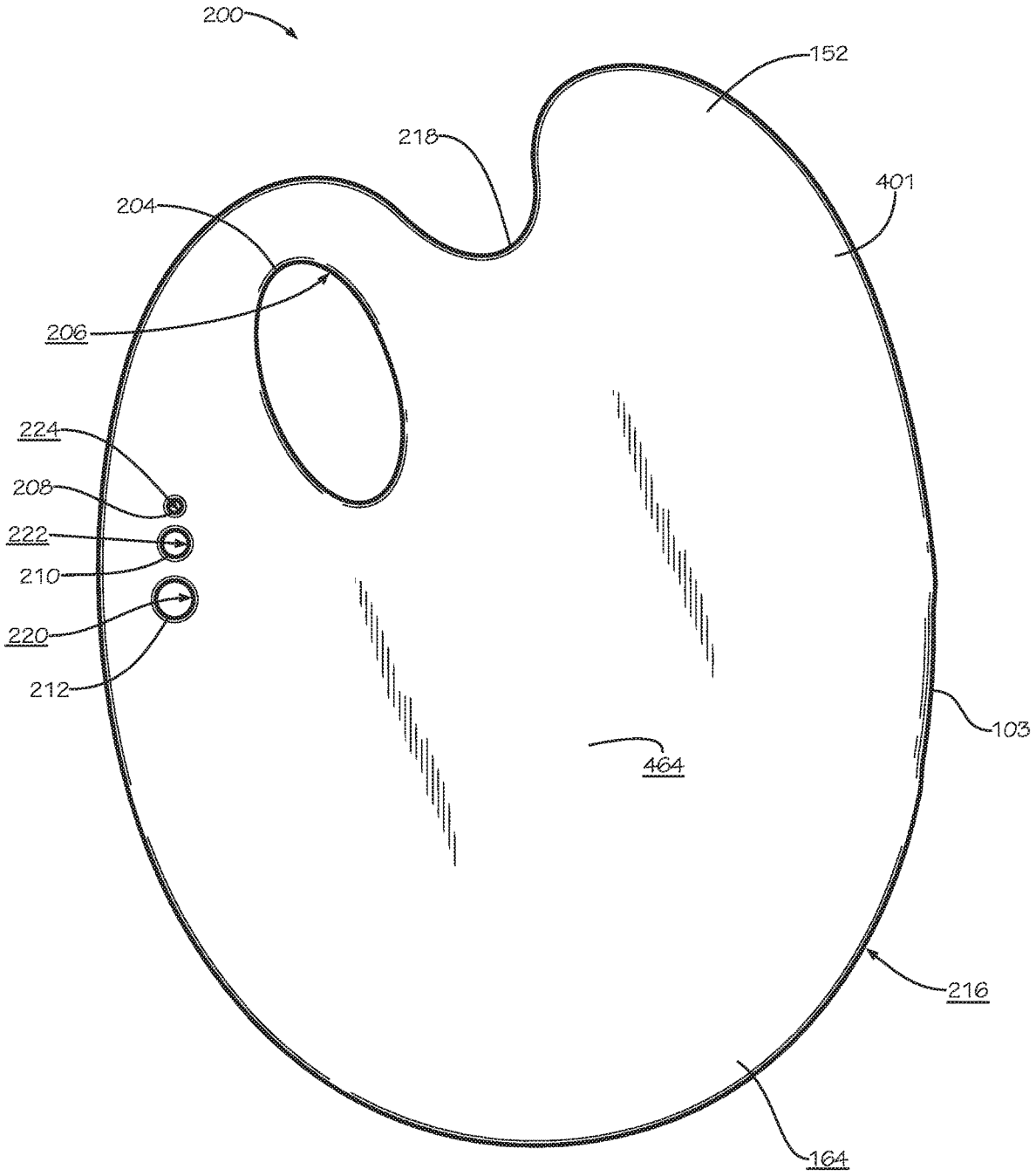
FIG. 4 is a bottom view of the palette of FIG. 2.
Figure 5:
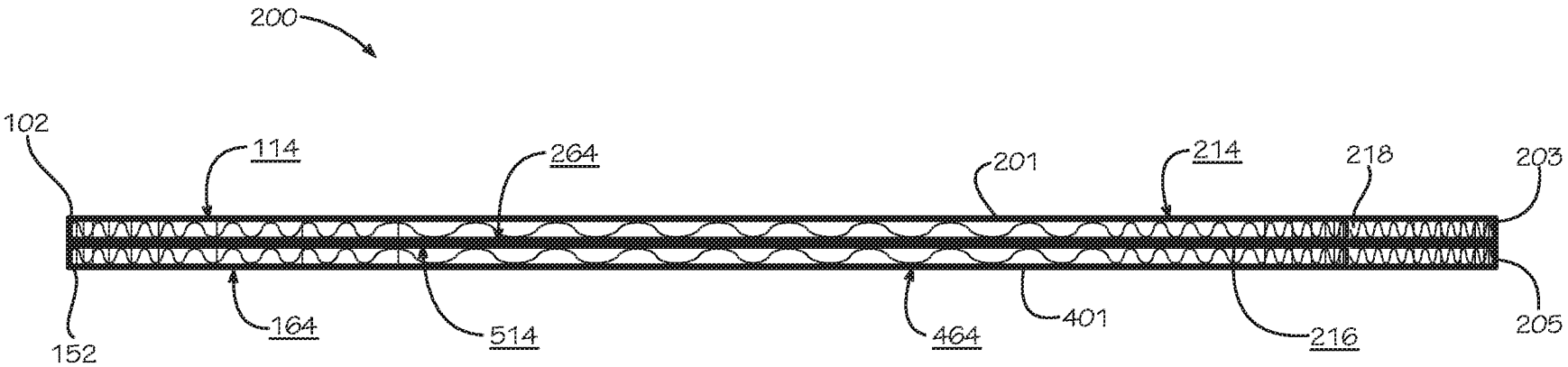
FIG. 5 is a front view of the palette of FIG. 2 taken along line 5-5.
Figure 6:
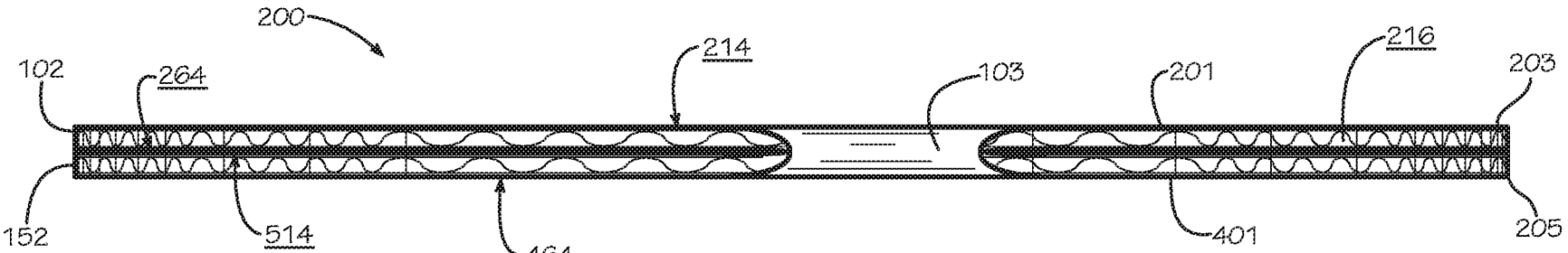
FIG. 6 is a back view of the palette of FIG. 2 taken along line 6-6.
Figure 7:
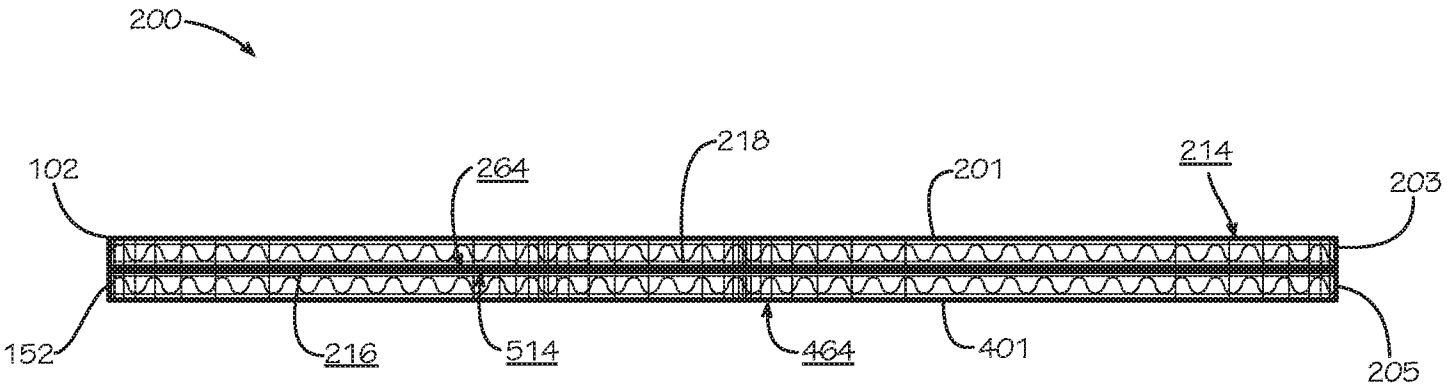
FIG. 7 is a side view of the palette of FIG. 2 taken along line 7-7.
Figure 8:
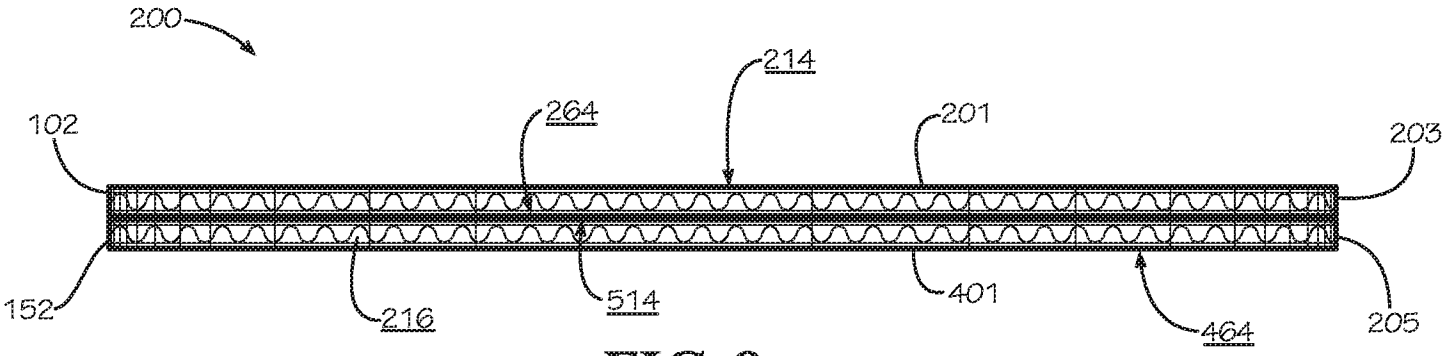
FIG. 8 is a side view of the palette of FIG. 2 taken along line 8-8.

FIG. 4 shows a bottom view of the palette 200 of FIG. 2. As previously described, the palette 200 shown in FIGS. 2-8 is formed by folding the foldable palette blank 100 about the hinge 103 in the first direction. In this configuration, the bottom 401 of the lower layer 205 is defined by the first support surface 164. Alternatively, were the foldable palette blank 100 folded in the second direction (not shown), the bottom 401 would be defined by the second support surface 264. As previously described, the palette hand hole 204 and the small palette brush hole 208, the intermediate palette brush hole 210, and the large palette brush hole 212 each extend through the palette 200 from the top 201 to the bottom 401. The reservoirs 226 do not extend through the lower layer 205.

FIGS. 5-8 respectively show front, back, and sides views of the palette 200 of FIG. 2. As shown, the working portion 102, or the upper layer 203, defines the top 201 while the support portion 152, or the lower layer 205, defines the bottom 401. When the foldable palette blank 100 is folded about the hinge 103 in the first direction, the top surface 214 is defined by the first working surface 114. A bottom surface 464 is defined by the first support surface 164. The second working surface 514 is flat against the second support surface 264. The hinge 103 connects the working portion 102 to the support portion 152.

In use, the user can fold the foldable palette blank 100 about the hinge 103 in either the first direction or the second direction to configure the palette according to the user's individual preference and hand dominance. The palette 200 can be gripped by the user in numerous ways. In the typical use, the user may insert a thumb of the hand through the palette hand hole 204 while gripping the palette notch 218 with fingers of the hand. According to this usage, the configuration shown in FIG. 2 would be held in the user's right hand with the bottom 401 resting on the right forearm. Alternatively, the user can insert the fingers of the hand through the palette hand hole 204 and grip the palette notch 218 with the palm and thumb of the hand. The user can pour a plurality of paints separately into the individual reservoirs 226. In order to create a specific shade of color, the user can mix paints of different colors from different reservoirs 226 on the top surface 214 of the palette 200. Methods for holding the using the palette 200 should not be viewed as limiting as an individual user can hold and utilize the palette 200 according to user preference.

The embodiment of the foldable palette blank 100 is comprised of corrugated cardboard; however, the material should not be viewed as limiting and the foldable palette blank 100 can be made of plastic, rubber, metal, paper, or any other material. In various embodiments, the first working surface 114, the second working surface 514, the first support surface 164, and the second support surface 264 can be coated with a coating. The coating can be applied to prevent the surfaces from absorbing liquids from the paint or to change the color of the surfaces, such as to make the surfaces white. A white surface can be desirable as a neutral background for mixing colors.

The method for assembling the palette 200 comprises obtaining the foldable palette blank 100 comprising the working portion 102 and the support portion 152, positioning the working portion 102 in facing contact with the support portion 152, aligning the working hand hole 104 with the support hand hole 154, and covering the reservoir holes 126 with the support portion 152 to form the respective reservoirs 226. The foldable palette blank 100 can comprise the hinge 103 which can flexibly connect the working portion 102 to the support portion 152, and positioning the working portion 102 in facing contact with the support portion 152 can comprise folding the foldable palette blank 100 about the hinge 103. The foldable palette blank 100 can be folded about the hinge 103 in a first direction to form a left-handed palette or in a second direction to form a right-handed palette.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described aspects are merely possible examples of implementations, merely set forth for a clear understanding of the principles of the present disclosure. Many variations and modifications can be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure. Moreover, although specific terms are employed herein, as well as in the claims which follow, they are used only in a generic and descriptive sense, and not for the purposes of limiting the present disclosure, nor the claims which follow.

That which is claimed is:

1. A method of forming a palette, the method comprising:

obtaining a foldable palette blank, the foldable palette blank defining a first blank surface and a second blank surface, the first blank surface defined opposite from the second blank surface, the first blank surface and the second blank surface each being planar when the foldable palette blank is in an unfolded configuration, the foldable palette blank comprising:

a working portion, the working portion defining a first working surface and a second working surface opposite from the first working surface, the first working surface defined by a first portion of the first blank surface, the second working surface defined by a first portion of the second blank surface, the working portion defining a first thickness between the first working surface and the second working surface, the working portion defining a working hand hole extending from the first working surface to the second working surface, the working portion defining a reservoir hole extending from the first working surface to the second working surface;

a support portion, the support portion defining a first support surface and a second support surface opposite from the first support surface, the first support surface defined by a second portion of the first blank surface, the second support surface defined by a second portion of the second blank surface, the support portion defining a second thickness between the first support surface and the second support surface, the second thickness being equal to the first thickness, the support portion defining a support hand hole extending from the first support surface to the second support surface, the support portion configured to cover an end of the reservoir hole; and a hinge flexibly connecting the working portion to the support portion, the first blank surface and the second blank surface extending across the working portion, the support portion, and the hinge;

positioning the working portion in facing contact with the support portion, the positioning comprising positioning the first working surface in facing contact with the first support surface;

aligning the working hand hole with the support hand hole; and covering the end of the reservoir hole with the support portion to form a reservoir.

2. The method of claim 1, wherein positioning the working portion in facing contact with the support portion comprises folding the foldable palette blank about the hinge.

3. The method of claim 2, wherein folding the foldable palette blank about the hinge in a first direction forms a left-handed palette and folding the foldable palette blank about the hinge in a second direction forms a right-handed palette.

4. The method of claim 1, wherein the working hand hole is symmetric to the support hand hole across a hinge axis.

5. The method of claim 1, wherein the working portion defines a working notch, the support portion defines a support notch, the support notch being symmetric to the working notch across a hinge axis, and wherein the working notch and the support notch form a palette notch when the foldable palette blank is in a folded position.

6. The method of claim 1, wherein the foldable palette blank is comprised of corrugated cardboard.

7. The method of claim 6, wherein the first support surface and the first working surface are defined by a first side of the corrugated cardboard, and wherein the second support surface and the second working surface are defined by a second side of the corrugated cardboard.

8. The method of claim 1, wherein the first support surface is coplanar with the first working surface when the foldable palette blank is in the unfolded configuration.

9. The method of claim 8, wherein the second support surface is coplanar with the second working surface when the foldable palette blank is in the unfolded configuration.

10. The method of claim 1, further comprising aligning a working brush hole with a support brush hole to form a palette brush hole, the working brush hole defined by the working portion, the support brush hole defined by the support portion.

11. The method of claim 1, wherein the first working surface, the second working surface, the first support surface, and the second support surface are substantially each planar.

12. The method of claim 1, wherein:

covering the end of the reservoir hole with the support portion to form the reservoir comprises covering the end of the reservoir hole with the first support surface; and the first support surface is planar.

13. The method of claim 1, wherein the first thickness is constant across the working portion, and wherein the second thickness is constant across the support portion.

14. The method of claim 1, further comprising repositioning the working portion and the support portion, the repositioning comprising:

separating the first working surface from the first support surface; and positioning the second working surface in facing contact with the second support surface.

* * * * *